US011247889B2

(12) United States Patent
LeFevre et al.

(10) Patent No.: US 11,247,889 B2
(45) Date of Patent: Feb. 15, 2022

(54) AUTO-CALIBRATING BEVERAGE FILL STATION

(71) Applicant: Twin Monkeys Beverage Systems, Inc., Aurora, CO (US)

(72) Inventors: Brian LeFevre, Brighton, CO (US); Josh Van Riper, Denver, CO (US)

(73) Assignee: Twin Monkeys Beverage Systems, Inc., Denver, CO (US)

( * ) Notice: Subject to any disclaimer, the term of this patent is extended or adjusted under 35 U.S.C. 154(b) by 0 days.

(21) Appl. No.: 15/929,406

(22) Filed: Apr. 30, 2020

(65) Prior Publication Data

US 2020/0346912 A1 Nov. 5, 2020

Related U.S. Application Data

(60) Provisional application No. 62/840,624, filed on Apr. 30, 2019.

(51) Int. Cl.
*B67C 3/20* (2006.01)
*B65B 3/28* (2006.01)

(52) U.S. Cl.
CPC ..... *B67C 3/202* (2013.01); *B65B 3/28* (2013.01)

(58) Field of Classification Search
CPC ..... B67C 3/202; B65B 3/28; B65B 57/145
See application file for complete search history.

(56) References Cited

U.S. PATENT DOCUMENTS 4,691,496 A * 9/1987 Anderson ..... B65B 57/10 141/144
4,878,333 A * 11/1989 Sommerfield ..... B65B 57/00 53/53
5,538,054 A * 7/1996 L uhmann ..... B67C 3/007 141/198
10,287,040 B2 5/2019 Rennerfeldt et al.
2007/0107801 A1* 5/2007 Cochran ..... G01F 13/006 141/153
2011/0147097 A1* 6/2011 Troisi ..... G01G 17/00 177/145
2019/0031376 A1 1/2019 Rennerfeldt et al.

OTHER PUBLICATIONS

SKA Fabricating, "Inline Date Coding: Quality Control Systems", Accessed on May 21, 2019 at https://skafabricating.com/date-inline-coding-systems/, pp. 1-5.

* cited by examiner

*Primary Examiner* — Jason K Niesz
(74) *Attorney, Agent, or Firm* — Husch Blackwell LLP

(57) ABSTRACT

An auto-calibration system for a beverage container packaging machine that includes a filler comprising one or more fill heads for filling one or more beverage containers. The filled beverage containers may be weighed at a weigh station of the auto-calibration system. A conveyance mechanism conveys a filled beverage container from the weigh station, wherein the conveyance mechanism may be clocked. The auto-calibration system may also include a control system in electronic communication with the conveyance mechanism and the weigh station. The control system optimizes the operation of the fill heads by tracking each of said one or more filled beverage containers, comparing the weight measured of each of said one or more filled beverage containers to a pre-determined target weight and a minimum weight; and then adjusting the operation of the one or more fill heads if said measured weight varies from said target weight.

3 Claims, 2 Drawing Sheets

AUTO-CALIBRATING BEVERAGE FILL STATION

CROSS-REFERENCE TO RELATED APPLICATIONS

This application claims priority to U.S. Patent Application No. 62/840,624 filed on Apr. 30, 2019 to Brian LeFevre and Josh Van Riper, the entire disclosure of which is incorporated herein by reference.

BACKGROUND OF THE INVENTION

In the beverage packaging industry, the packagers need to ensure that the customer is receiving a minimum amount of product based upon the volume of the package and applicable consumer protection laws. There is also a need in the art to provide a beverage container packaging machine that can automatically calibrate the operation of the fill head(s) so that (1) the package contains at least the minimum amount of contents to reduce the number of rejected products, and (2) the operation of the machine can continue for extended periods without having to shut down by adjusting operation of the fill heads consistently provide the desired amount of material.

SUMMARY OF THE INVENTION

The present invention is directed toward an auto-calibration system for a beverage container packaging machine to optimize the amount of liquid that is placed into each beverage container. The auto-calibration system may include a filler or fill station that comprises one or more fill heads, wherein each fill head will fill one beverage container. The auto-calibration system may also include a weigh station for weighing each of the filled beverage containers. There is a conveyance mechanism for conveying the filled beverage container from the filling station to the weigh station.

The auto-calibration system may also include a control system that is in electronic communication with the conveyance mechanism and the weigh station. This allows the control system to track the position of each of said one or more filled beverage containers and to associate or correlate each of the filled beverage containers with the fill head that filled that container. The control system may also compare the weight measured of each of said one or more filled beverage containers to a predetermined target weight and a minimum weight for each filled beverage container. The control system is then capable to adjust the operation of the one or more fill heads if said measured weight varies from said target weight. The control system may reduce the amount of liquid dispensed if the weight is too high, or increase the amount of liquid dispensed if the weight is too low.

The auto-calibration system may also include a rejection station wherein the control system signals a rejection of the filled beverage container if said measured weight is below the pre-determined minimum weight.

The control system may also correlate the weighed filled beverage container to one of the one or more fill heads that filled the weighed beverage container, and the control system adjusts the operation of the respective one of the one or more fill heads if the measured weight varies from said target weight.

The auto-calibration system may also include features which allow for the fill of a container to be optimized by tracking the position of the fill head within the beverage container as it fills the beverage container. Ideally, the fill head is just near the top of the liquid level when it shuts off to avoid (1) spills and introducing too much air into the beverage if the fill head is above the liquid level, or (2) under filling the container leaving too much air trapped in the container if the tube is shut off too low in the beverage container. The auto-calibration system may include a sensor disposed at the filler, wherein the sensor is disposed at a position to measure the position of at least one of the one or more fill heads of when the fill head shuts off.

A method for auto-calibrating a beverage packaging system comprising the steps of: filling one or more beverage containers with one or more respective fill heads of a filling station, wherein the number of beverage containers matches the number of fill heads; conveying the one or more filled beverage containers from the filling station to a weigh station; weighing one of the one or more filled beverage containers; associating the one of the one or more filled beverage containers with the respective one of the one or more fill heads from which it was filled; comparing the weight of the one of the one or more filled beverage containers to a target weight and a minimum weight; and adjusting the operation of the one or more fill heads if said measured weight varies from said target weight.

The method for auto-calibrating a beverage packaging machine may also include the step of tracking the beverage containers as they are conveyed downstream to the other stations such as the weigh station or the seaming station. The method may also include rejecting one of the one or more filled beverage containers if the weight is below the minimum weight.

The method for auto-calibrating the beverage packaging machine may also include the step of optimizing a vertical position of one or more fill heads at the time the fill heads shut off when filling a beverage container so that each of the fill heads shuts off when the fill heads are at an optimum location measured by a sensor positioned to determine the vertical position of one or more fill heads.

Other aspects and advantages of the present invention will be apparent from the following detailed description of the preferred embodiments and the accompanying drawing figures.

DESCRIPTION OF THE SEVERAL VIEWS OF THE DRAWINGS

In the following, an advantageous embodiment of the present invention will be explained in more detail making reference to a drawing, in which the individual figures show.

DETAILED DESCRIPTION OF THE INVENTION

Figure 1:
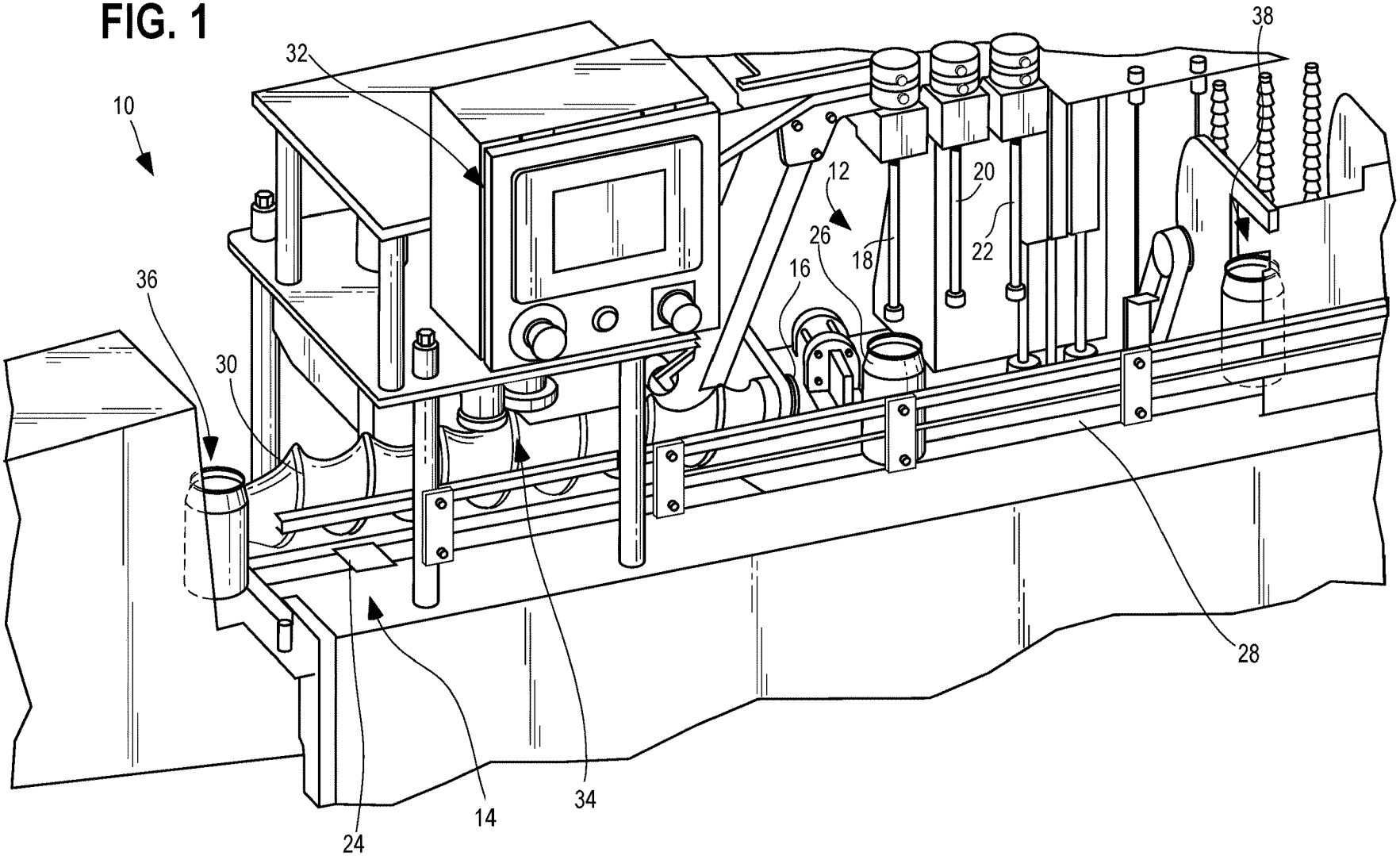
FIG. 1 is a perspective view of one embodiment of an auto-calibrating beverage fill station of a canning machine in accordance with the teachings of the present disclosure.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

Figure 2:
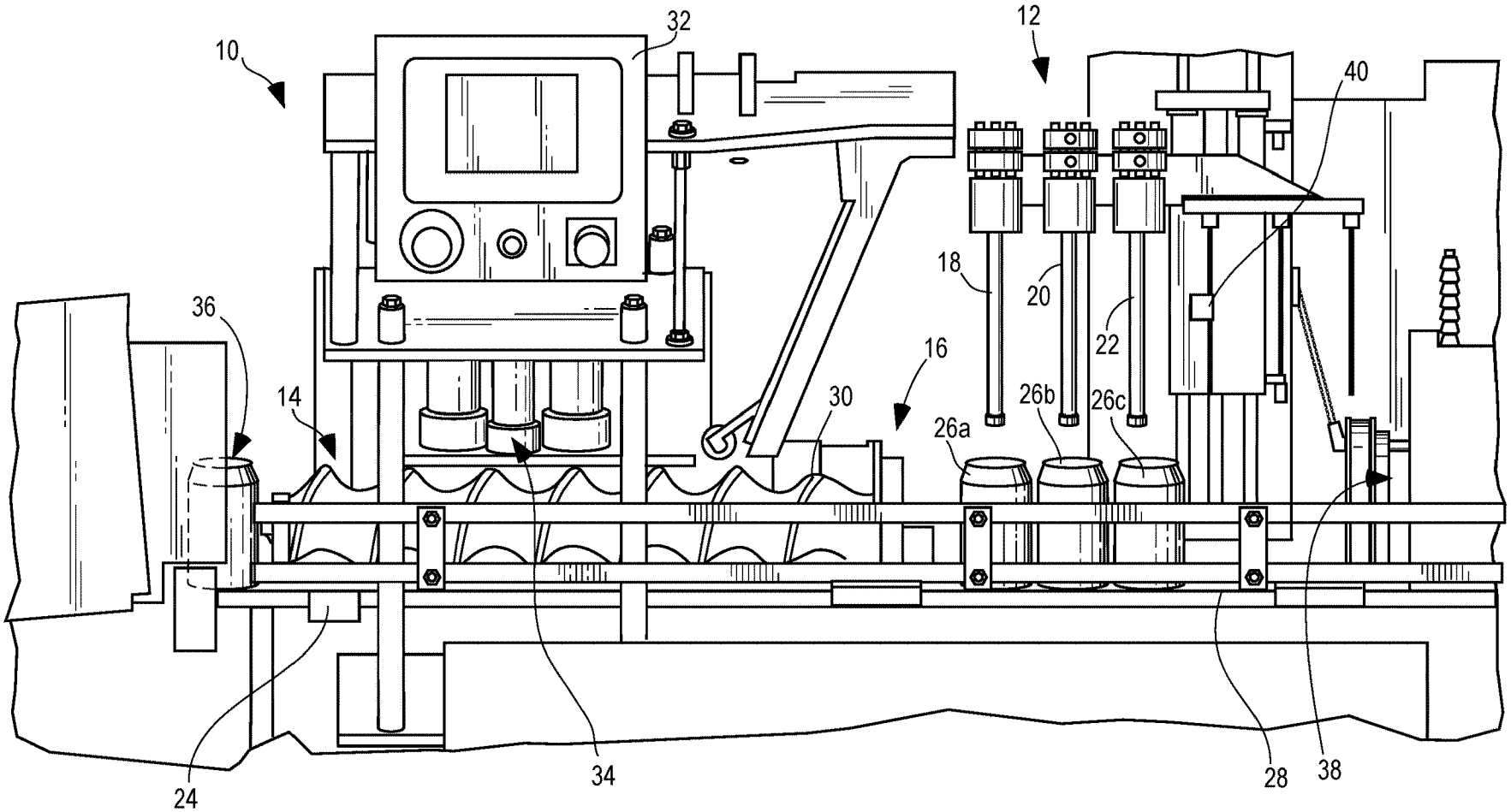
FIG. 2 is a front view of the embodiment of the auto-calibrating beverage fill station of FIG. 1.

The purpose of the present invention is to fill beverage containers 26 with a consistent and accurate volume of fluid. As shown in FIGS. 1 and 2, in one embodiment, the beverage containers 26 are filled in a packaging machine 10 including at least a fill station 12, a weighing station 14, a conveying system 16 and a control system 32 that is in electronic communication with one or more of the fill station 12, the seaming station 34 and the weighing station 14. As shown in FIG. 1, the packaging machine 10 may include a seaming station 34 and this station may also be in electronic communication with control system 32. Cans 26 may be introduced into the fill station 12 from a can feeder/feed supply 38.

In one embodiment, a beverage container 26 is a can, and the fill station 12 includes three fill heads—a first fill head 18, a second fill head 20, and a third fill head 22—that fill three different beverage containers 26*a*, 26*b*, and 26*c* at the same time. However, a fill station 12 having any number of fill heads is within the scope of the present invention.

Generally, at the fill station 12, beverage container 26 is filled with a quantity of a material, often a liquid, wherein beverage container 26*a*, 26*b*, and 26*c* have a fill head 18, 20, or 22 inserted therein. The machine 10 generally is done filling the beverage container 26 by either knowing how long the fill heads have been left open (a time measurement) or how much liquid has passed through to each of the fill heads (flow measurement). The aim of the present system is to fill the beverage containers 26 with the correct amount of liquid each time they are filled in each container 26 with a respective fill head. In the embodiment that fills three containers 26*a*, 26*b*, and 26*c*, at a time, the present system ensures the correct amount of liquid in all three beverage containers 26*a*, 26*b*, and 26*c*.

After the beverage containers 26*a*, 26*b*, and 26*c* are filled, the beverage containers 26*a*, 26*b*, and 26*c* then will pass through the remainder of the packaging system. A lid (not shown) is applied at the seaming station 34 and the cans 26*a*, 26*b*, and 26*c* and lids are seamed to create an air-tight and fluid tight can as known in the art. Next, the seamed cans 26*a*, 26*b*, and 26*c* are each weighed at the weigh station 14, which in one embodiment is near the end of the system. At the weigh station 14, a control system 32 compares the weight of the beverage container 26 to a predetermined target weight that the customer has entered using the touch-screen or display of the control system 32 or otherwise indicated. The control system 32 then determines whether container 26 is at weight, underweight or overweight and which fill head 18, 20, or 22 it came from and, therefore, which fill head 18, 20, or 22 may need adjusting.

In one example, if the container 26 came from fill head 20 and it is underweight, then the device will adjust fill head 20 to remain on a little longer or have a bit more flow through the fill head next time. If the system is running on timers it will adjust the filling timer up a small amount. If the system is running on flow meters, it will adjust the meter count upward a little. In a preferred embodiment, this adjustment very minimal, just a little bit at a time and the system is configured for long term calibration rather than trying to make big changes. Big changes may result in some level of splashing as the fill head 18, 20, 22 goes in or out of a beverage container 26.

In one embodiment, the present machine 10 is configured so the fill heads 18, 20 and 22 supply the correct fill zone all the time to ensure that all of the containers contain enough of the material so that container can be sold. Generally, the present system 10 weighs the beverage containers after they are filled, then makes small adjustment to each fill head if needed and then the system also compares that weight with a lower boundary limit of underweight beverage container 26. There will be an ideal target weight and a minimum weight under which beverage container 26 would be labeled as a reject and if it's a reject then it waits until it gets to the reject station 36 and the system kicks it out. The present machine 10 preferably keeps the containers 26 being filled at the ideal target weight so that any variance underweight is still above the minimum weight.

The present machine 10 typically does not reject for an overweight beverage container 26 because you can still sell that beverage container 26. However, overfilled beverage containers essentially give away product, so for efficiency and profit margins, controlling against overfilling beverage containers is also performed by the present machine 10. The present machine 10 is set to avoid overfills by similarly measuring a weight and correcting and/or calibrating the fill levels on a fill head basis.

The system can use any number of fill heads, wherein some embodiments use three and some may use five. A key feature of the present machine 10 is tracking which fill head filled each respective container and correlating the weighed can with the fill head for proper calibration.

In an embodiment with five fill heads, the system will know that there's a group of five traveling together. Each of the five containers is tracked from the fill head it came from to the weigh station 14, the present machine 10 can determine which can was from fill head one, two, three, four and five. This allows the system to go back and correct the correct fill head based upon the right information measured. The weigh station 14 may comprise a load cell 24 or other known electronic weighing mechanism.

And in one embodiment, the present machine 10 tracks the beverage containers 26 through the process. Regardless of how many heads are there we have to be able to track the beverage containers 26 so we know which individual beverage container 26 came from which individual fill head.

In one embodiment, the control system 32 can track the location of each beverage container 26 in each batch using one or more of encoded software, measured time, and conveyance speed. Other tracking mechanisms may be used as well.

In one embodiment, the system can track each beverage container 26 in a batch using a screw drive 30 and the system knows that every time that the screw 30 revolves one revolution, the beverage containers 26 move one space. For example, in one revolution a certain beverage container 26 goes from point A to point B, with two revolutions, it makes it down to point C, and 3, 4, and 5 revolutions to points D, E and F. The system may also track the beverage containers 26 as they travel from the fill station 12 to the screw drive 30, as in that zone in some machines 10, the beverage containers' 26 movement is not so controlled, so an operator has to know when an operator releases the beverage containers 26 from the fill station 12, to start looking for when they line up with this screw 30 so that the control system 32 can then start determining which beverage container 26 is which, and/or which beverage container 26 was filled at which fill head 18, 20, and 22.

In other embodiments, not shown, the conveyor system 16 may comprise one or more separate conveyers. Another embodiment, may have some other mechanism and there might be a bigger zone where the movement of the can is not indexed like that of a screw or star-wheel. Conveyors, such as star-wheels, conveyor belts, or other conveyance mechanisms may be utilized. In this zone, the system may track and determine which beverage container comes from which fill head, either 18, 20, and 22. In one embodiment, the beverage container 26 may be manually placed on the weigh station 14.

Generally, in one embodiment, the system will track which fill head filled a particular beverage container so that the system can calibrate that fill head using the measured weight of the beverage container 26 at the weighing station 14 to determine the quantity of the liquid.

In other embodiments, the tracking of the beverage containers 26 may be correlated with the fill heads 18, 20 or 22 based upon time and/or patterns determined by sensors for detecting the presence of a beverage container 26, and correlating that with the fill quantity of the beverage containers 26.

In one embodiment, the packaging machine 10 may include a rejection station 36 wherein the packaging machine can reject a sealed or unsealed filled beverage container for a number of reasons. In one embodiment, the beverage containers 26 may be rejected if under the minimum weight. The beverage container may be rejected for other reasons as well not just an underweight reason, for example, if a lid is missing from a beverage container or it is leaking. In one embodiment, the present system may take multiple actions with only one weight, in particular, two different things, auto adjust the fill heads of the fill station 12 upstream and reject an underweight container 26 downstream.

The benefits of the present machine 10 are that it increases and optimizes profitability because it ensures that the right amount of liquid is in the beverage container. It also optimizes profitability and efficiency of operating the packaging machine 10 because it reduces the amount of rejected beverage containers 26. Moreover, embodiments of the present machine 10 may be capable of accommodating for slow failures or slow things that go on in the fill head itself, which allows an operator to run the machine longer without having to repair or replace the fill head, and to continually optimize the fill.

In the present machine 10, at a designated point in the fill cycle the container is almost completely full and the machine 10 needs to start withdrawing these fill heads 18, 20, and 22 which themselves take up some of volume of that beverage container. The withdrawal needs to be performed while the fill heads are still filling the container because, otherwise, the liquid level will fall because there was too much displacement from the tubes themselves thereby resulting in a container that is underfilled. In one embodiment, the fill heads and the present machine 10 will fill while the fill heads are stationary at the bottom of the container and then at a certain point in time, the present machine 10 will start to raise the fill heads while they are still filling.

In a preferred embodiment, the present machine 10 shuts off the fill heads while they're still under liquid but just barely. This is beneficial because you don't want the liquid to splash down from above which causes more oxygen to get back in the container. On the other hand, the fill heads shouldn't be turned off too early because then by the time the fill heads are pulled out, the level at the top of the container will drop down a little which could pull air in at that point as well.

As shown in FIG. 2, the packaging machine 10 may include a sensor 40 or process to detect if the fill heads 18, 20 and 22 are being shut off at the right time. In one embodiment, it may take the form of a sensor 40 disposed at the fill station 12, wherein the sensor 40 is disposed at a position to measure the position of the fill head 18, 20 and 22 of when it shuts off. The sensor 40 may also detect if the fill head 18, 20 and 22 is very far below the sensor 40, then the present machine 10 will know it is shutting off the fill heads 18, 20 and 22 too early and if the fill head 18, 20 and 22 is above the sensor 40, then the fill head shut off is occurring too late. The goal is to have the fill head 18, 20 and 22 shut off right when the fill heads 18, 20 and 22 hit the sensor 40 so that the fill settings can be used for the next cycle. The machine 10 may adjust when the fill head 18, 20 and 22 starts to withdraw from the container to start up a little earlier next time or a little later based upon the measured position of the fill head 18, 20 and 22 when the volume of the liquid is dispensed.

In use, when the filling has taken place and you've got a set of three filled beverage containers 26, a conveyor stop withdraws and three beverage containers 26 are released. The containers 26 move on conveyor 28 and further upstream the next empty containers are stopped when container is right in front of fill head 18 and filled. In one embodiment, the three containers 26 that were released downstream and filled, go into a screw 30 which indexes one beverage container 26 at a time and they advance through a process of move stop, move stop and every time they stop, the machine 10 can do things like seam the beverage container 26 and weigh the beverage container 26 and reject a beverage container 26.

The seaming, weighing and rejection of a filled beverage container generally take place one beverage container 26 at a time, and upstream the present machine 10 is filling and tracking three beverage containers 26 at a time.

In another embodiment, the conveyor 16 may include a star wheel that just moves the beverage containers 26 off the conveyor 16 into a seamer 34 and then back to the conveyor 16 again. This embodiment allows the can to come off the conveyor 16 to allow the packaging machine to perform the seaming of the can. In this embodiment, the weighing station could be located off the conveyor 16 such that when the can is moved off the conveyor 16 for a seam, the star-wheel can move the can to another spot for weigh and then move it back on to the conveyor 16 to move down the line.

In another embodiment, the controller 32 may adjust all of the fill heads of a machine at once. This adjustment could be made in circumstances where the tank volume reduces as a result of the packaging process. As the amount of fluid in a supply tank lowers, the pressure on the liquid being deposited into the beverage containers also lowers, which affects all of the fill heads simultaneously, not just one at a time. Accordingly, the present invention also includes the controller adjusting all of the fill heads of a particular machine simultaneously using by a running average of the weight measurements and adjusting the flow measurement or time duration of the fill head operation of all fill heads based upon the running average of the weight.

Beverage containers 26 may be aluminum or steel cans or kegs of any volume; metal, plastic or glass bottles of any volume; or other known beverage containers 26, including king cans, tall boys, or crowlers.

In one embodiment of a quality control aspect of the present autocalibration system and packaging machine 10 may work more generally as follows. Beverage containers 26 begin the process of working their way through the system are marked as "good" initially as they are inducted early into the machine. The beverage containers 26 may be tracked through the entire canning process. The beverage containers 26 may be designated as a "reject" at several points for reasons like "no lid on can" or "pressure dropped during seaming." Any filled beverage container 26 that arrives at the seamer that is a "good" can is seamed; those that are "reject" are not seamed and continue to the reject lane. Beverage containers 26 can be changed to "reject" at seam if the pressure drops too low. Then any seamed beverage containers 26 that arrive at the weigh station 14 that are labeled "good" are weighed; those beverage containers 26 that are deemed "reject" are not weighed. However, the weigh station 14 is generally disposed after the seaming station, so in one embodiment, the weigh station 14 may be the last "quality control" station of the packaging machine 10. At the weigh station 14, the weights of the cans are compared against the target weight and adjustments are made to the fill amount at the respective fill head that the particular beverage container 26 was filled. The weights of the beverage containers 26 are also compared against the minimum weight and those that are under the weight are then changed to "reject." Thus, the filled and seamed beverage containers 26 are tracked through the packaging machine 10 and when they reach the reject station, any beverage containers 26 that are designated as "reject" at any time through the process are sent to the reject lane and any that are good are allowed to pass onward for further packaging and distribution.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A method for auto-calibrating a beverage packaging system comprising the steps of:

filling one or more beverage containers with one or more respective fill heads of a filling station, wherein the number of beverage containers matches the number of fill heads;

conveying the one or more filled beverage containers from the filling station to a weigh station;

weighing one of the one or more filled beverage containers;

associating the one of the one or more filled beverage containers with the respective one of the one or more fill heads from which it was filled;

comparing the weight of the one of the one or more filled beverage containers to a target weight and a minimum weight;

adjusting the operation of the one or more fill heads if said measured weight varies from said target weight; and optimizing a vertical position of each of the one or more fill heads at the time each of the one or more fill heads shuts off the filling of a respective one of the one or more beverage containers so that each of the one or more fill heads shuts off when the fill heads are at an optimum shut off location measured by a sensor disposed to determine the vertical position of each of the one or more fill heads.

2. The method for auto-calibrating a beverage packaging machine according to claim 1 further comprising the step of tracking the one or more beverage containers during the conveying the one or more filled beverage containers step.

3. The method for auto-calibrating a beverage packaging machine according to claim 1 further comprising the step of rejecting the one of the one or more filled beverage containers if the weight is below the minimum weight.

* * * * *